United States Patent [19]

de Witt

[11] Patent Number: 4,558,530

[45] Date of Patent: Dec. 17, 1985

[54] SNAP IN CYLINDERS FOR REVOLVERS

[76] Inventor: Clinton J. de Witt, 610 Laurel Dr., Sacramento, Calif. 95825

[21] Appl. No.: 634,481

[22] Filed: Jul. 25, 1984

Related U.S. Application Data

[63] Continuation-in-part of Ser. No. 525,673, Aug. 23, 1983.

[51] Int. Cl.[4] ..... F41C 1/00

[52] U.S. Cl. ..... 42/59; 42/89

[58] Field of Search ..... 42/59, 62, 65, 89; 248/221.3, 221.4, 544; 403/14, 16, 166

[56] References Cited

U.S. PATENT DOCUMENTS

| | | | |
|---|---|---|---|
| 1,202,343 | 10/1916 | Wesson et al. | 42/89 |
| 2,382,676 | 8/1945 | Swartz | 42/62 |
| 2,944,359 | 7/1960 | Hanley | 42/89 |
| 3,145,495 | 8/1964 | Katz et al. | 42/59 |
| 3,163,951 | 1/1965 | Lewis | 42/59 X |
| 3,490,164 | 1/1970 | Rohm | 42/62 |
| 3,685,193 | 8/1972 | Sefried | 42/59 X |
| 3,711,982 | 1/1973 | Baker | 42/62 |
| 3,744,171 | 7/1973 | Fecke | 42/89 |
| 3,765,116 | 10/1973 | Zaid | 42/89 |
| 3,824,729 | 7/1974 | Kubik | 42/89 |
| 3,874,104 | 4/1975 | Sibley | 42/62 X |
| 3,955,301 | 5/1976 | Wiethoff | 42/89 X |
| 4,141,165 | 2/1979 | Dichter et al. | 42/59 X |
| 4,288,938 | 9/1981 | Kahn | 42/59 |
| 4,316,339 | 2/1982 | Herriott | 42/59 |
| 4,318,239 | 3/1982 | Phillips | 42/89 |
| 4,357,774 | 11/1982 | Badger | 42/59 |
| 4,391,056 | 7/1983 | Bornancini | 42/62 |

OTHER PUBLICATIONS

"Combat Revolver Update: Death-Dealing Wheelguns, Ammo & Tactics" by P. G. Wrighter.
"Second-Chance Firepower Fast" by Samuel T. Scott.
"Handling Speedloaders" by Tom Ferguson.

*Primary Examiner*—David H. Brown
*Assistant Examiner*—John E. Griffiths
*Attorney, Agent, or Firm*—Leonard Bloom

[57] ABSTRACT

A revolver has a cylinder which is completely removable. Upon actuation of an ejection lever, the cylinder is automatically ejected laterally of the revolver frame. A new fully-loaded interchangeable cylinder, with cartridges securely retained therein, is then quickly and easily snapped into place within the revolver frame. This replacement is effected without visual supervision or special training. The speed and simplicity of the reloading process make the revolver suitable for use by law enforcement personnel.

14 Claims, 12 Drawing Figures

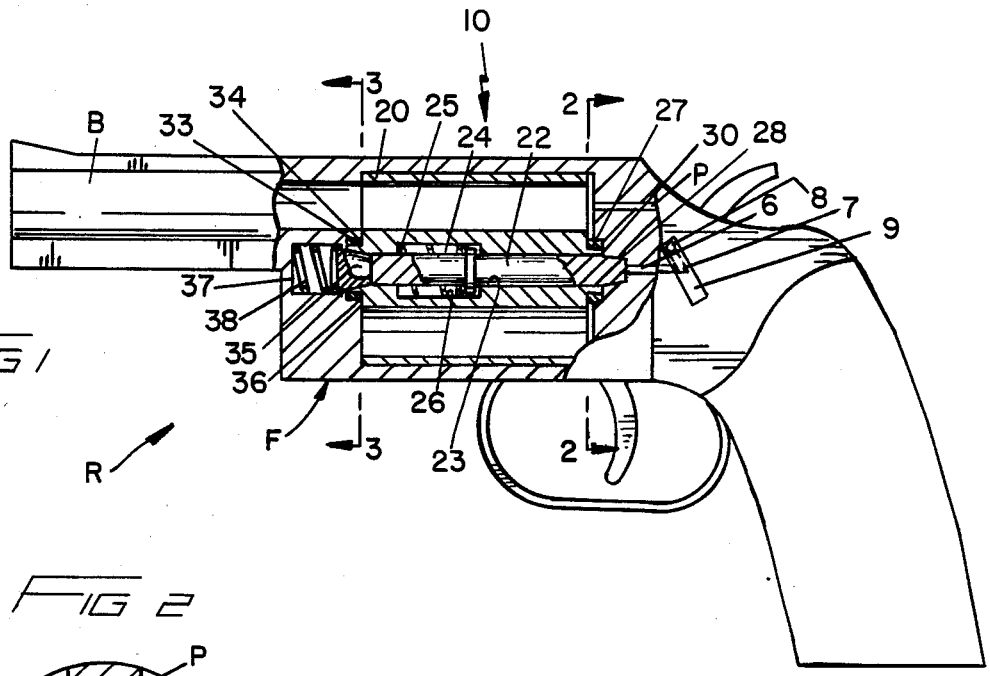
FIG 1
FIG 2
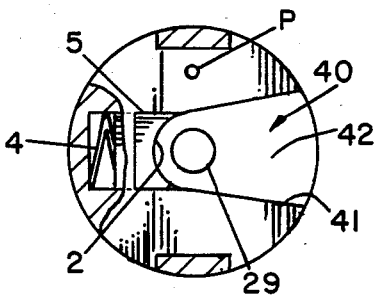
FIG 3
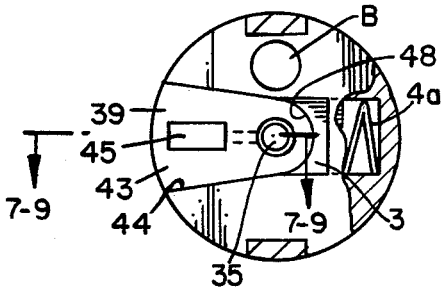
FIG 4
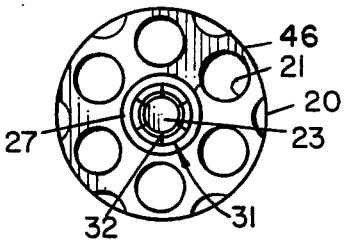
FIG 5
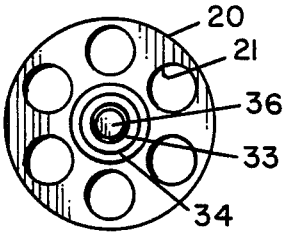
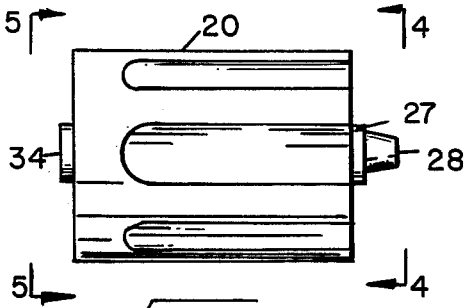
FIG 6

SNAP IN CYLINDERS FOR REVOLVERS

CROSS-REFERENCE TO RELATED APPLICATION

The present application constitutes a continuation-in-part of application Ser. No. 525,673 now pending filed Aug. 23, 1983, the disclosure of which is incorporated herein it its entirety.

FIELD OF THE INVENTION

The present invention relates generally to firearms, and more specifically, to revolvers provided with cylinders which are quickly and easily removed and replaced.

BACKGROUND OF THE INVENTION

The most commonly used handguns are revolvers and semi-automatic pistols. There are advantages and disadvantages associated with both of these types of firearms.

The semi-automatic pistol is loaded with a clip-type of magazine. This magazine holds more rounds of ammunition than the cylinder of the typical revolver and is easier to load and unload. However, for repeated fire, a sequence of cartridges must be fed into the same chamber, then ejected, which often results in a jammed mechanism. The semi-automatic may be "single action" or "double action". The "single-action" semi-automatic is normally carried "cocked and locked" by law enforcement personnel. This means that the hammer mechanism is cocked and ready to fire at the slightest trigger pressure, but the hammer is held in place by an exterior safety device, which must be released in order to operate the weapon. When ready to fire, the hammer and magazine springs of the "single-action" semi-automatic are under constant compression. As a result, the long term reliability of this weapon is decreased, and additional maintenance and repair are required. In contrast, the "double-action" semi-automatic can be fired without releasing a safety mechanism, but requires a greater trigger pressure for the first round than for succeeding rounds, in turn requiring an adjustment by the shooter. Moreover, the magazine spring of a "double-action" semi-automatic is also under constant compression.

Mechanically, the revolver is simpler than the semi-automatic pistol. In addition, the revolver mechanisms are unstressed when ready to fire. As a result, the revolver is easier to operate and maintain, and is less prone to accidental discharge and jamming, than the semi-automatic pistol. For these reasons, the revolver is preferred to the semi-automatic by most law enforcement agencies.

A major disadvantage of the revolver is the length of time needed for reloading. This disadvantage has been partially alleviated by the development of the "speed loader." Typically, the commercially available speed loader maintains a full reload of fresh cartridges in an arrangement which conforms to the configuration of the cylinder bores. The speed loader thereby allows a full complement of cartridges to be transferred to the cylinder simultaneously, rather than individually.

However, there are disadvantages associated with the use of the speed loader. First, when a law enforcement officer using the speed loader is under fire, the officer's eyes must be taken off of the assailant in order to align the speed loader with the cylinder in order to reload.

During the reloading, the assailant may maneuver and thereby gain a strategic advantage. Second, the proper use of a speed loader requires considerable training and practice. Even an expert in the use of the speed loader may require at least five seconds to accomplish this task. Third, many speed loaders fail to adequately protect the ammunition while in storage. Thus, if the speed loader were accidently dropped, the ammunition may become damaged or misaligned.

In the known prior art, revolver cylinders have been permanently mounted to the revolver frame by means of a crane pivot or linkage. These crane mechanisms may fail after a period of time due to the relatively-high impact loads incurred during firing of the revolver. Additionally, in the known prior art, the ejection and replacement means for such cylinders are cumbersome and time consuming, and are intended solely for maintenance rather than reloading.

SUMMARY OF THE INVENTION

Accordingly, it is an object of the present invention to alleviate the disadvantages of the prior art by providing a revolver having a readily removable cylinder, one which is easily and automatically ejected from the revolver frame, so that a second, preloaded cylinder may be quickly and easily installed without looking away from the target.

It is another object of the present invention to provide a revolver having a cylinder which is easily removed and installed, thereby eliminating the necessity of the crane mechanisms of the prior art.

It is yet another object of the present invention to provide a cylinder with cartridges securely retained therein which may be removed completely from the revolver, thereby rendering the revolver inoperable for safe storage, even if discovered by an unauthorized person (such as a child); yet readily reloaded when needed.

It is yet still another object of the present invention to provide a revolver having several removable and interchangeable fully-loaded cylinders with cartridges securely retained therein, thereby providing the revolver with the firepower normally associated with a semi-automatic pistol.

It is a further object of the present invention to provide a revolver with quickly removable and installable cylinders with cartridges securely retained therein to greatly reduce the reloading time associated with a service revolver, thereby substantially reducing the risk of bodily harm to law enforcement personnel.

It is a still further object to provide law enforcement or military personnel the opportunity to adapt a revolver to changing needs, as for example, exchanging a cylinder loaded with standard ammunition for one loaded with high power or armor-piercing ammunition.

It is a yet still further object to provide a revolver having easily removable and installable cylinders for reloading, without requiring extensive training and practice.

It is, again, another object of the present invention to provide a revolver having a readily removable and installable cylinder, yet one which is relatively reliable, durable, free of jamming problems, and adaptable to mass production methods.

In accordance with the teachings of the present invention, a preferred embodiment is herein disclosed, wherein a revolver includes a frame having a completely removable cylinder therein. The cylinder is adapted to be easily replaced with a second fully-loaded cylinder. A retention means secures the cartridges within the cylinder from unintentional dislodgement. A first resilient means maintains the retention means in its engaged position, thereby maintaining the cylinder in the frame. A manually-operable release means opposes the first resilient means for selectively moving the retention means into its disengaged position. When the retention means is disengaged, one or more resilient means automatically eject the cylinder completely from the frame. In this manner, a revolver can be reloaded quickly by ejecting the first cylinder from the frame and inserting the second cylinder therein, without the necessity for looking at the revolver.

BRIEF DESCRIPTION OF THE DRAWINGS

FIG. 1 is a longitudinal view, partially in section, of a revolver incorporating the teachings of the present invention.

FIG. 2 is a section view taken across lines 2—2 of FIG. 1, showing a guide channel in the revolver frame for the replaceable cylinder, and further showing one of the second resilient means for biasing the cylinder towards automatic ejection from the revolver frame.

FIG. 3 is a section view taken along the lines 3—3 of FIG. 1, showing the actuation ramp, centering pin, and one of several ejection means.

FIG. 4 is an rear end view of the cylinder, removed from the revolver.

FIG. 5 is a front end view of the cylinder, removed from the revolver.

FIG. 6 is an elevation of the cylinder, showing respective anti-friction devices on forward and rear collars on the respective end faces of the cylinders, and further showing a rearwardly-protruding tapered portion of a central shaft carried by the cylinder.

FIG. 7 shows an anti-friction device (preferably, a roller bearing) which is carried by a forward collar on the cylinder, and which engages a retractable spring-loaded actuation ramp mounted in the forward portion of the revolver fame.

FIG. 8 show the actuation ramp and integrally-formed tapered centering pin in its fully retracted position, as the cylinder moves further into the revolver frame.

FIG. 9 shows the tapered centering pin in its fully extended position within a tapered pocket on the face of the cylinder, such that the cylinder is in its operative position, and the revolver is ready for firing.

DESCRIPTION OF THE PREFERRED EMBODIMENT

Figure 10:
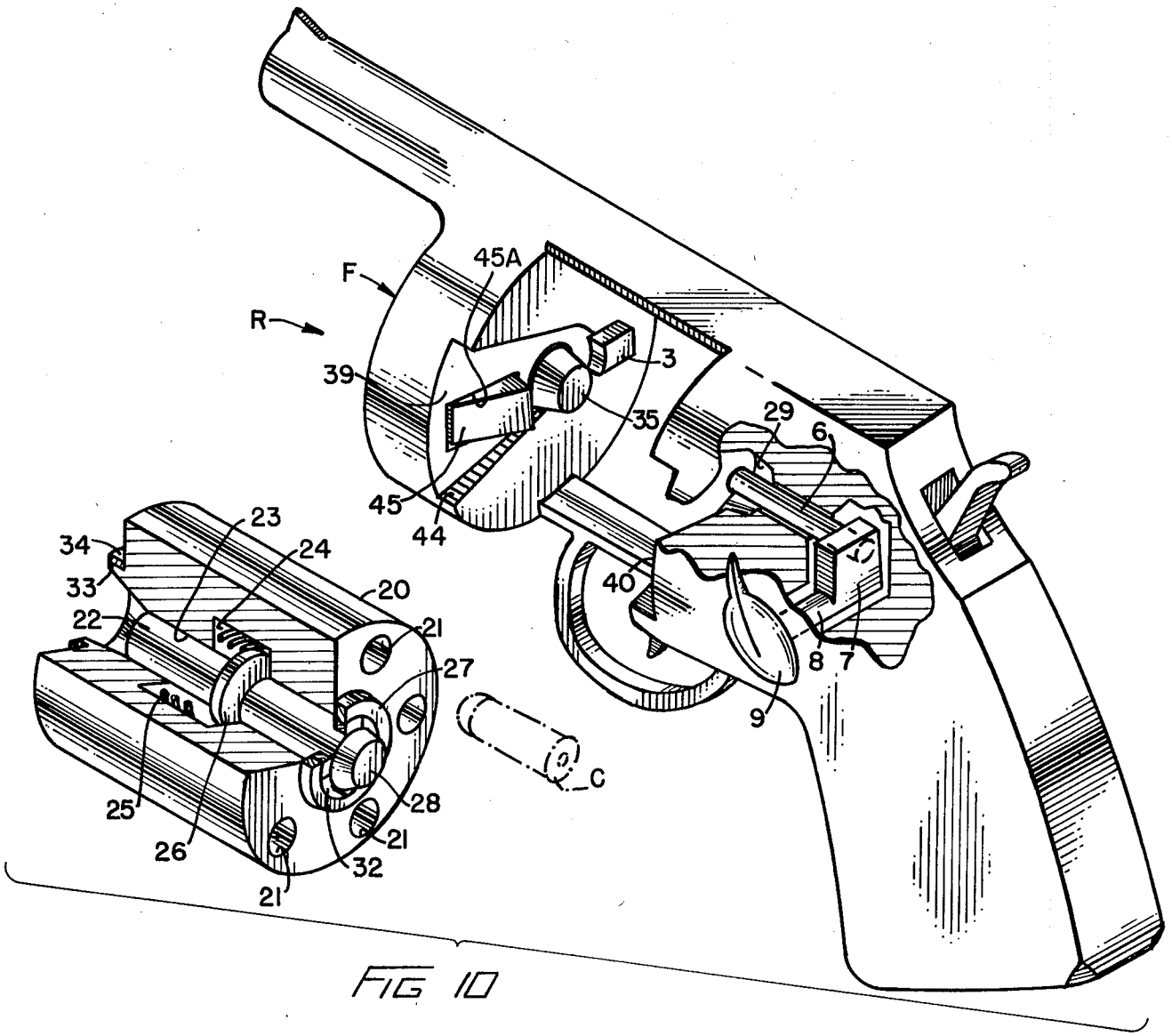
FIG. 10 is an exploded isometric view of the revolver and its detached cylinder, ready for insertion into the revolver.
Figure 11:
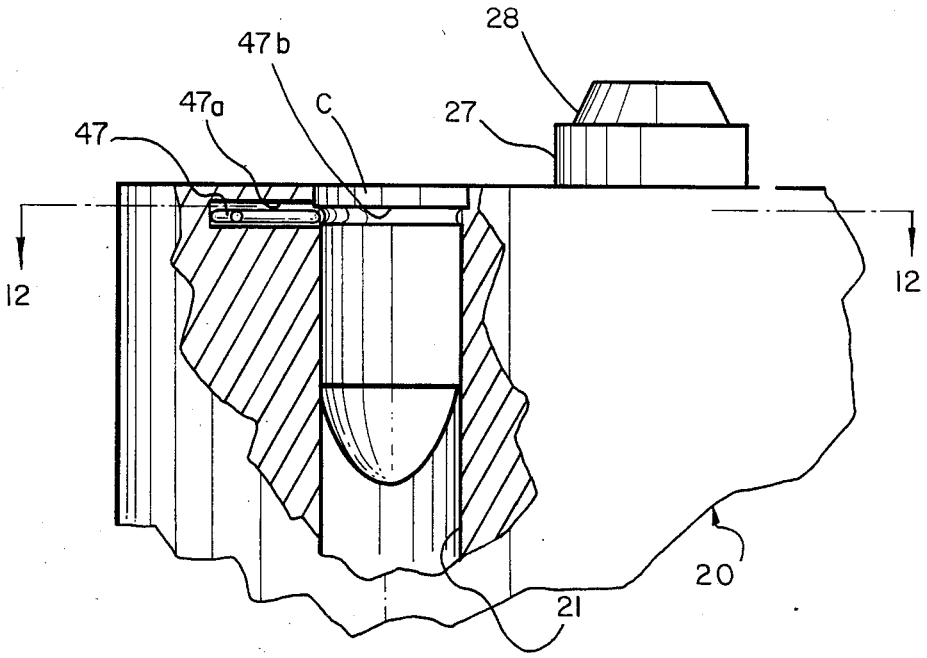
FIG. 11 is a longitudinal section of a portion of the cylinder, showing a resilient means for retaining the cartridge within its respective bore in the cylinder.
Figure 12:
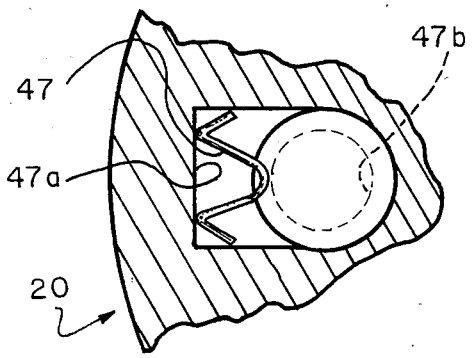
FIG. 12 is a section view thereof, taken across the lines 12—12 of FIG. 11.

With reference to the drawings, a revolver R has a frame F for receiving a removable cylinder 20. The removable cylinder 20 has longitudinal bores 21 for receiving cartridges C, one of which is shown in broken lines in FIG. 10. The cylinder also has a central bore 23 having an expanded portion 24. A shaft 22 is loosely received within the central bore, such that the cylinder may rotate freely about the shaft. A spring 25, within the expanded portion of the central bore, contacts a shoulder 26 on the shaft and biases the shaft rearwardly. As a result, the shaft has a restricted longitudinal movement within the central bore of the cylinder.

The rear end face of the cylinder is reduced to form a collar 30. An anti-friction device, such as a roller bearing 27, is press-fitted on the collar. A rear face of the collar 30 has a ratchet plate 31, shown more clearly in FIG. 4, having a series of ramps 32 concentrically of the central bore. The ramps 32 provide the advancing means, so that the cartridge bores 21 are brought into firing position, in series, as the trigger is pulled. A tapered rear portion 28 of the shaft protrudes from the rear face of the cylinder and is received in a complemental rear pilot bore 29, as shown more clearly in FIGS. 1 and 10.

The forward end face of the cylinder is also reduced to form a forward collar 33. An anti-friction device, such as a roller bearing 34, is press-fitted on the collar 33. The forward end of the central bore in the cylinder has a tapered counterbore 49 concentrically of collar 33. This tapered counterbore forms a forward pilot bore for receiving a complementary spring-loaded tapered centering pin 35.

The frame of the revolver has a centering pin cavity 37, as shown more clearly in FIG. 1. A spring 38 is received in the cavity and urges the centering pin 35 rearwardly. The centering pin is received within a tapered counterbore 49 in the cylinder, thereby displacing the shaft 22 rearwardly. When the shaft 22 is displaced rearwardly, the tapered rear portion 28 of the shaft is received within the pilot bore 29 in the revolver frame, as shown in FIG. 1. The cylinder 20 is seated in the revolver frame and is retained in a first operative mode, which permits only rotational motion of the cylinder, and the revolver is ready for firing. During firing, the various cylinder bores 21 are alternately aligned with the barrel of the revolver, and the cartridges in the barrel may be sequentially discharged in the usual manner.

To install the cylinder 20 within the revolver, a forward guide channel 39 (sbown in FIG. 3) and a rear guide channel 40 (shown in FIG. 2) are formed in the revolver frame. The rear guide channel 40 is defined by shoulders 41 which taper or converge inwardly of the revolver frame. The inner surface of the rear guide channel 40, between the shoulders 41, defines an inclined ramping surface 42. This ramping surface 42 contacts and gradually depresses the shaft 22 during installation of the cylinder 20 within the revolver frame. The shoulders 41 engage and direct the outer surface of the roller bearing 27, thereby guiding the cylinder until the roller bearing 27 is substantially aligned with the rear pilot bore 29. At that point, the tapered rear end portion 28 of the shaft 22 "snaps" into engagement with the rear pilot bore 29. The cylinder is then in its seated and operational position.

Figure 9:
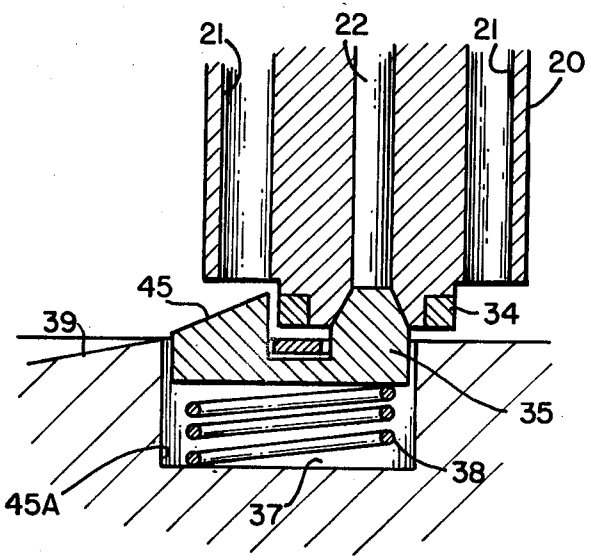
FIGS. 7, 8, and 9 are section views, taken across lines 7,9—7,9 of FIG. 3, drawn to an enlarged scale, and showing (in sequence) the insertion of the removable cylinder into the revolver frame.
Figure 8:
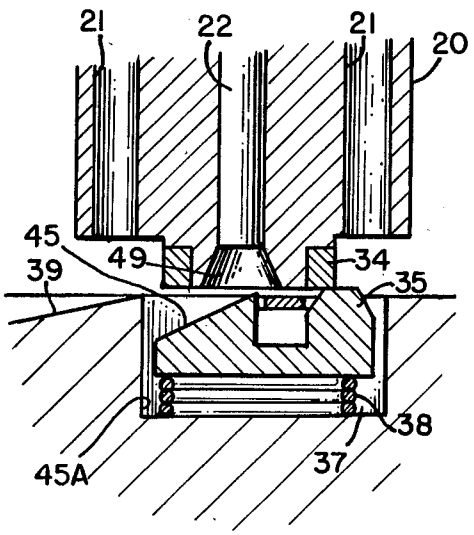
Figure 7:
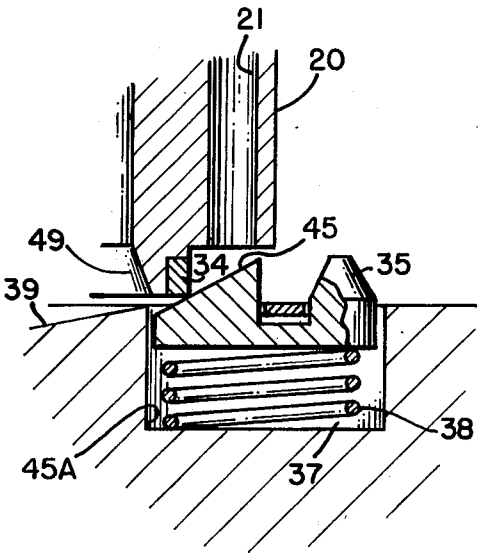

Similarly, the forward guide channel 39 within the revolver frame has an inclined ramping surface 43 with shoulers 44 to guide the forward portion of the cylinder 20 into its seated operational position. As the forward roller bearing 34 engages and is directed up the ramped surface 43, the bearing 34 engages an inclined actuation ramp 45. This ramp 45 protrudes through an opening 45A in the forward guide channel 39, as shown in FIG. 7, thereby depressing the spring loaded ramp. The ramp is formed integrally with centering pin 35, and the centering pin 35 is withdrawn within the confines of the cavity 37 (as shown more clearly in FIG. 8). When advanced beyond this point and into the operational position, the centering pin 35 once again returns to its fully extended position, seating itself within the tapered counterbore 49 as shown in FIG. 9. As shown in FIGS. 2 and 3, the stops 5 and 3 have surfaces 2 and 48, respectively, which are complementally formed to receive and match with the outer surface of the cylindrical roller bearings 27 and 34. When the cylinder is in its operative position, the respective bore 21 is directly aligned at its front end with the barrel B (FIG. 3) and with the firing pin P (FIG. 2) at its rear end.

In order to remove the cylinder 20 from the revolver frame, the ejection lever 9 is pressed forwardly. This rotates a pivot shaft 8 which carries an actuation lever 7. The actuation lever pushes an ejection shaft 6 forwardly in the revolver frame, and the ejection shaft displaces the cylinder shaft 22 forwardly until the rear portion of the shaft 22 is flush with the ratchet plate 31. At that point, the shaft and the cylinder carried thereby are released from the means which retains the cylinder within the revolver frame. Thereafter, the rear stop 5 and the forward stop 3, spaced from one another, automatically eject the cylinder 20 from the revolver frame. These stops 5 and 3 are constantly urged by resilient means 4 and 4*a*, respectively, from a first retracted position in which the cylinder 20 is in its seated operational mode within the revolver frame (ready for firing of the revolver) into a second extended position in which the cylinder is automatically ejected from the revolver frame.

Spring clips 47 (or other suitable retaining means) are provided to retain the cartridges within the cylinder, thereby retaining the cartridges even if the cylinder is inverted. In a preferred embodiment, each spring clip 47 is substantially V-shaped and is snapped within a closed pocket 47A communicating with the bore 21 for the cartridge C. The apex of the "vee" is received in the annular groove 47B formed in the cartridge C near the annular rim at the base of the cartridge.

In operation, the revolver may be provided with at least two cylinders 20. After a full load of cartridges is discharged, the first cylinder may be removed quickly and easily by simply pressing the ejection lever 9 forwardly. The stops 3 and 5 then thrust outwardly laterally of the revolver frame, thereby automatically ejecting the first cylinder from the revolver frame. Thereafter, a second fully-loaded cylinder 20 may be quickly and easily "snapped" into the revolver frame. This is accomplished by aligning the guide channels 39 and 40, respectively, and pressing the second cylinder inwardly until the stops 3 and 5 are depressed. The tapered end 28 (of the cylinder shaft 22) and the tapered centering pin 35 are seated in tapered bores 29 and 49, respectively, to seat the second cylinder within the revolver frame in its operational position, such that the revolver is again ready for firing. After the second cylinder 20 has discharged its full complement of cartridges, a third cylinder may be employed if desired. Thus, a series of preloaded cylinders may be carried on a utility belt, for example, and snapped into the revolver frame (as needed) to provide for quick and efficient reloading.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In a revolver having a removable cylinder, the combination of a revolver frame having at least one guide channel formed therein laterally thereof, the guide channel having an opening formed therein, an inclined ramp projecting through the opening in the guide channel, a tapered centering pin connected to the ramp for movement in unison in a direction longitudinally of the revolver frame, and resilient means biasing the centering pin and ramp longitudinally of the frame.

2. In a revolver adapted for shooting at a target, the combination of a revolver frame, a cylinder completely removable from the frame, a plurality of cartridges within the cylinder, resilient means for maintaining the cartridges within the cylinder, whereby the cylinder can be held in any orientation without the cartridges falling out of the cylinder, guide means formed within the revolver frame, whereby the cylinder can be guided within the frame, resiliently-biased retention means in the frame, whereby the cylinder can be snapped into the frame, ejection means in the revolver frame for selectively disabling the retention means, and resilient means for ejecting the cylinder, whereby the cylinder can be forcibly ejected completely out of the revolver frame and completely disassociated therefrom, and whereby an interchangeable cylinder loaded with fresh cartridges can be snapped into the revolver frame without looking away from the target.

3. In a revolver including a frame having a handle and a trigger forwardly thereof, wherein a handle is grasped by the user's palm and wherein a user's trigger finger engages the trigger, the combination of a cylinder adapted to be inserted within the frame laterally thereof, guide means cooperating between the cylinder and the frame for facilitating the slidable insertion of the cylinder within the frame, displaceable resiliently-biased retention means carried by the frame for receiving the cylinder within the frame, an ejection lever carried by the frame in juxaposition to the trigger for selective actuation by the user's thumb, means in the frame and responsive to the actuation of the ejection lever for displacing the retention means, and biasing means for automatically ejecting the cylinder completely out of the frame laterally thereof.

4. The combination of claim 3, wherein said means for displacing comprises an ejection shaft guided for sliding movement in the revolver frame longitudinally thereof, the ejection shaft having a forward end portion engaging the resiliently-biased retention means for displacing the retention means forwardly of the revolver frame, the ejection shaft further having a rearward end portion, an actuation lever bearing against the rearward end portion of the ejection shaft, and a pivot shaft in the frame transversely of the ejection shaft and carrying the actuation lever and the ejection lever, respectively.

5. In a revolver including a frame having a first removable cylinder therein, wherein the cylinder is adapted to be replaced with a second fully-loaded interchangeable cylinder substantially identical to said first cylinder, a retention means cooperating between said first cylinder and the frame for maintaining said first cylinder within the frame, the retention means having an engaged and a disengaged position, first resilient means exerting a force longitudinally of the revolver frame for biasing the retention means in its engaged position, thereby maintaining said first cylinder in the frame, manually-operable release means opposing the first resilient means for moving the retention means into its disengaged position, second resilient means independent of the first resilient means and exerting a force laterally of the revolver frame for automatically ejecting said first cylinder completely free of and away from the revolver frame when the retention means is in its disengaged position, and means in the revolver frame for guiding said first cylinder within the frame, whereby said first cylinder can be seated within the frame against the force of the second resilient means, and whereby the retention means is again in its engaged position for maintaining said first cylinder in the frame, thereby facilitating a quick and easy reloading of the revolver.

6. The improvement of claim 5, wherein the release means comprises an ejection shaft carried by the revolver frame and having a limited longitudinal movement therein, the ejection shaft having a rear portion and being substantially aligned with the shaft within the bore of first said cylinder when said first cylinder is installed in its operative position in the revolver frame, a pivot shaft mounted in the revolver frame transversely of the ejection shaft and having inner and outer ends, an actuation lever carried on the inner end of the pivot shaft and bearing against the rear portion of the ejection shaft, and an external ejection lever carried on the outer end of the pivot shaft, whereby forward movement of the ejection lever pivots the pivot shaft through an angle, and whereby the actuation lever pushes the ejection shaft forwardly in the revolver frame to displace said shaft within the bore of the first cylinder and the centering pin forwardly in the revolver frame, thereby releasing the retention means and automatically ejecting said first cylinder from the revolver.

7. The improvement of claim 5, wherein said first two ends with cylinder has respective bearings on said ends, and wherein the second resilient means for automatically ejecting said first cylinder comprises respective spring-loaded stops carried by the revolver frame and contoured to engage the respective bearings on said first cylinder when said first cylinder is seated in its operational position within the revolver frame, and respective springs carried by the revolver frame and constantly urging the stops in a direction laterally of the revolver frame.

8. The improvement of claim 5, wherein said first cylinder is provided with bores adapted to receive cartridges therein, and wherein said first cylinder is provided with resilient means for maintaining the cartridges in the respective bores.

9. The improvement of claim 5, wherein the retention means comprises said first cylinder having a central bore formed therein, a shaft loosely received within the bore, whereby said first cylinder can rotate freely on the shaft, means between the shaft and said first cylinder for allowing the shaft to have a limited movement axially of said first cylinder, the shaft having a tapered rear end, the revolver frame having a rear complementary-tapered pilot bore for receiving the tapered rear end of the shaft, the revolver frame further having a forward closed cavity formed therein, a tapered centering pin within the cavity and urged rearwardly of the frame by the first resilient means, said first cylinder having a forward end face provided with a tapered counterbore for receiving the tapered centering pin in the engaged position of the retention means.

10. The improvement of claim 9, wherein the means between the shaft and said first cylinder for allowing the shaft to have a limited movement axially of said first cylinder, comprises said first cylinder having respective ends and further having a closed radially-expanded portion of the bore intermediately the ends of said first cylinder, the shaft having a shoulder formed thereon within the expanded portion of the bore, and a spring seated within the expanded portion of the bore and bearing against the shoulder, thereby urging the shaft rearwardly of said first cylinder.

11. The improvement of claim 9, wherein the first resilient means comprises a coil spring within the forward closed cavity in the revolver frame and bearing against the tapered centering pin.

12. The improvement of claim 9, wherein said first cylinder further has a rear end face, wherein the forward and rear end faces of said first cylinder have respective reduced-diameter collars formed thereon, and wherein respective bearings are carried by the collars.

13. The improvement of claim 12, wherein the means in the revolver frame for guiding said first cylinder within the frame includes forward and rearward guide channels formed in the revolver frame, and wherein the respective bearings carried by the collars on said first cylinder are guided within the respective guide channels.

14. The improvement of claim 13, wherein the forward guide channel has an opening, and wherein an actuation ramp protrudes through the opening in the forward guide channel, the actuation ramp being connected to the tapered centering pin for movement in unison.

* * * * *